United States Patent [19]

Ziliani

[11] Patent Number: 4,460,112

[45] Date of Patent: Jul. 17, 1984

[54] FOLDING CLOTHES STAND STRUCTURE

[75] Inventor: Franco Ziliani, Brescia, Italy

[73] Assignee: Norda Tubazioni S.p.A., Brescia, Italy

[21] Appl. No.: 315,093

[22] Filed: Oct. 26, 1981

[30] Foreign Application Priority Data

Nov. 3, 1980 [IT] Italy ..... 25743 A/80

[51] Int. Cl.[3] ..... A41D 27/22

[52] U.S. Cl. ..... 223/88; 223/89; 223/95

[58] Field of Search ..... 223/85, 88, 89, 95

[56] References Cited

U.S. PATENT DOCUMENTS

| | | | |
|---|---|---|---|
| 2,194,191 | 3/1940 | Wolf | 223/95 X |
| 2,509,578 | 5/1950 | Scherquist | 223/95 |
| 3,150,776 | 9/1964 | Van Dusen | 223/88 X |

FOREIGN PATENT DOCUMENTS

| | | | |
|---|---|---|---|
| 523412 | 4/1955 | Italy | 223/95 |
| 527636 | 6/1955 | Italy | 223/85 |
| 601468 | 1/1960 | Italy | 223/85 |
| 210066 | 6/1940 | Switzerland . | |
| 730048 | 5/1955 | United Kingdom | 223/95 |
| 928293 | 6/1963 | United Kingdom | 223/88 |

*Primary Examiner*—Louis Rimrodt

*Attorney, Agent, or Firm*—Guido Modiano; Albert Josif

[57] ABSTRACT

The folding clothes stand comprises first and second rod-like elements, adapted to support a coat and trousers, which are mutually hinged together, and being effective to be arranged in a first position, of use, in which the rod-like elements lay on mutually substantially perpendicular planes, and in a second position, of rest or non-use, in which one of the rod-like elements is totally included within the outline defined by the other of the rod-like elements.

5 Claims, 8 Drawing Figures

VIII
VIII

FOLDING CLOTHES STAND STRUCTURE

BACKGROUND OF THE INVENTION

This invention relates to a folding clothes stand structure.

As is known, currently marketed clothes stands comprise in general wooden frames or frames of some other materials, which define suitable shaped supports for hanging coats and trousers therefrom.

Clothes stands of conventional design, however, are presently of generally great bulk because, when not in use, cannot be significantly reduced in size, so that they are in practice items of relative inconvenience for their users.

SUMMARY OF THE INVENTION

It is a primary object of this invention to eliminate such prior art drawback by providing a folding clothes stand structure, which while exhibiting the same functional features of known clothes stands, affords the possibility of drastically reducing its bulk when not in use.

It is a further object of the invention to provide a folding clothes stand structure which can ensure the highest degree of functionality and reliability in use.

Another object of this invention is to provide a folding clothes stand, which can be quickly assembled in a very simple manner, and which can be manufactured at a very low production cost, thus favoring its acceptance by potential users thereof.

These and other objects, such as will be apparent hereinafter, are all achieved by a folding clothes stand structure according to the invention, comprising first and second rod-like elements, respectively adapted to support a coat and trousers, characterized in that said first and second rod-like elements are mutually hinged together for positioning into a first use position, in which said rod-like elements lay in mutually substantially perpendicular planes, and into a second non-use position, in which one of said rod-like elements is fully contained within the outline of the other of said rod-like elements.

BRIEF DESCRIPTION OF THE DRAWING

Further features and advantages will be more apparent from the following detailed description of a folding clothes stand structure, illustrated by way of example and not of limitation in the accompanying drawing, where.

DESCRIPTION OF THE PREFERRED EMBODIMENTS

Figures 1, 2, 3, 4, 5, 6, 7, 8:
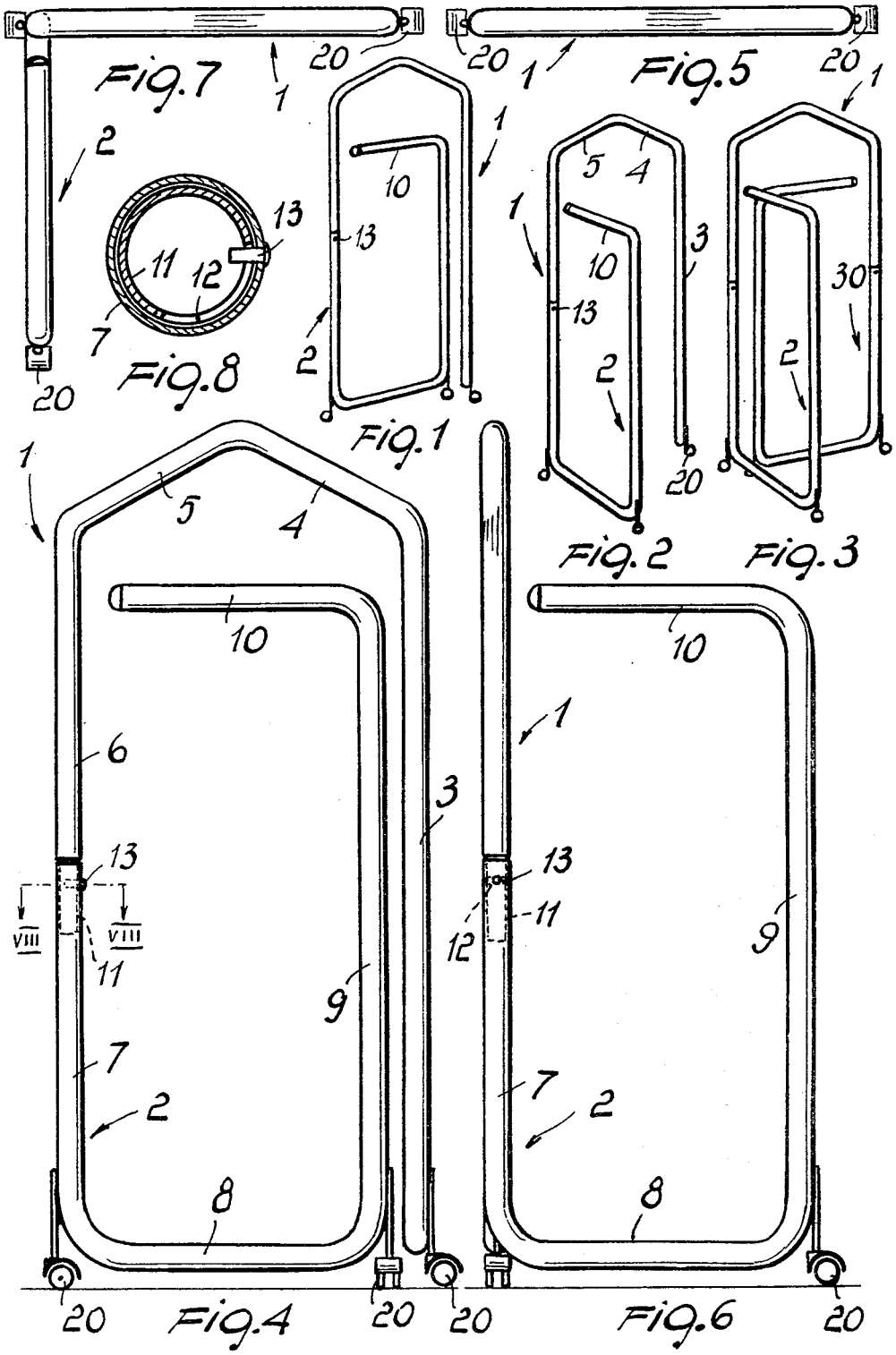
FIG. 1 shows schematically and in perspective this clothes stand, in the folded non-use position thereof.
FIG. 2 is a perspective view of the clothes stand in the in-use position thereof.
FIG. 3 shows this clothes stand with two trousers supporting elements.
FIG. 4 is an elevation view of the clothes stand, shown in its closed or folded condition.
FIG. 5 shows the clothes stand in its folded condition as viewed from above.
FIG. 6 is an elevation view of the clothes stand, shown in the in-use condition thereof.
FIG. 7 is a top plan view of the clothes stand in the in-use condition thereof.
FIG. 8 is a sectional view taken along the line VIII—VIII of FIG. 4.

With reference to the drawing figures, the folding clothes stand according to this invention comprises a first shaped rod-like element, indicated at 1, which is adapted for supporting a coat hanging therefrom, and a second shaped rod-like element, indicated at 2, which is adapted to support trousers hanging therefrom.

The first rod-like element 1 includes a plurality of coplanar straight portion comprising a vertically extending upright 3, which is connected at the top to two oblique sections 4 and 5, so arranged as to form a cusp element adapted to provide support for a garment part such as a coat, to the ends of which sections there is connected a downwardly extending vertical upright, indicated at 6 constituting a terminal straight portion of the shaped rod-like element. From the drawing it will be noted that the shaped rod-like element has in part a loop-like configuration.

The downward vertical upright 6 is hinged to a vertical section 7 of the second rod-like element such as to enable relative rotation about a vertical axis between the first and second rod-like elements, 1 and 2.

The vertical section 7 which constitutes a terminal straight portion of the second shaped rod-like element is connected, at the bottom, to a lower horizontal section 8, which is connected with the other end to an upward vertical section 9, connected at the top to an upper horizontal section 10 which extends transverse to the terminal straight portion 6 and functions in practice as a trousers or other garment part supporting element or member.

More in detail, the length of the section 8 is less than the distance separating the two uprights 3 and 6 thereby, in the folded condition, the second rod-like element 2 is completely enclosed within the outline or area surrounded by the first rod-like element 1, so that in the position of non-use, the clothes stand assumes a fully flattened configuration having a depth or thickness dimension which is substantially equal to the thickness of the rod-like elements employed the two shaped rod-like elements clearing each other.

The hinge connection or rotatable joint between the first rod-like element 1 and second rod-like element 2, which may be provided at any location within the vertical area defined by the upright 6 and vertical section 7, is implemented by means of a tube 11 which is telescopically inserted into the vertical section 7.

Moreover, to prevent an unintentional separating sliding movement out of the tube 11, a slot 12 is provided which extends substantially along one quarter of a circle and in which a pin 13 or the like member, carried on the vertical portion 7, can be engaged for sliding movement. Thereby a telescopical coupling is provided.

The coupling just described, additionally to preventing the upright 6 and vertical section 7 from sliding off each other, also provides a means of arranging a travel limiter for the rotational movement which defines the position of use of the stand, wherein the first rod-like element 1 and second rod-like element 2 extend in substantially mutually perpendicular planes, and its position of non-use or stowing position, wherein the second rod-like element 2 is arranged practically coplanar with the first rod-like element 1 and is fully included within the outline or bulk dimension it establishes.

Furthermore, it should be added that quite advantageously at the lower ends of the vertical upright 3, vertical section 7, and upwardly vertical section 9, there ae provided resting formations in the form of caster wheels, as generally indicated at 20.

With reference to FIG. 3, there is shown an embodiment of the invention, similar to the previously described one, wherein two wearing apparel supporting elements are provided; in this case, the vertical upright 3 is discontinued at a middle portion thereof to provide a second terminal straight portion, and a third rod-like element, indicated at 30, is hinged swivelled to it with a third terminal straight portion the third rod-like element having substantially the same configuration as the second rod-like element and includes a third support for a third garment portion as visible in FIG. 3.

It will be appreciated from the foregoing that the invention achieves its objects, and in particular that the structure described hereinabove provides a clothes stand structure which is quite practical and functional, as well as being implemented with extremely simple means, and affords the possibility of significantly reducing its bulk dimensions, thus solving all the problems of transportability and facilitating the stand stowage when not in use.

The invention as illustrated is susceptible to many modifications and variations without departing from the scope of the instant inventive concept.

Moreover, all of the details may be replaced with other technically equivalent elements. In practicing the invention, the materials used, and the dimensions and contingent shapes, may be any selected ones to fit individual requirements.

I claim:

1. A folding clothes stand structure comprising a first shaped rod-like element having a first plurality of coplanar straight portions bent with respect to each other to define a first part of loop-like configuration extending in a first plane and surrounding a first area, at least a second shaped rod-like element having a second plurality of coplanar straight portions bent with respect to each other to define a second part of loop-like configuration extending in a second plane, said second loop-like configuration part being smaller than said first loop-like configuration part thereby to be contained within said first area and clearing said first loop-like configuration part when said first and said second loop-like configuation parts assume a position coplanar to each other, said first plurality of straight portions including one terminal straight portion having first rotatable joint means thereon defining an axis of rotation coaxial with said one straight portion and said second plurality of coplanar straight portions including another terminal straight portion having second rotatable joint means matingly connectable with said first rotatable joint means in coaxial relationship therewith thereby to align said one terminal straight portion with said another terminal straight portion and to allow said first part of loop-like configuration and said second part of loop-like configuration to perform relative rotation with respect to each other about said axis of rotation, said first plurality of coplanar straight portions including at least one section thereof extending transverse to said one terminal straight portion to provide a first support portion for a garment portion, said second plurality of coplanar straight portions including at least another section thereof extending transverse to said another terminal straight portion to provide at least a second support portion for another garment portion, said first shaped rod-like element having first rest formations on a side thereof opposite said first support portion and said second shaped rod-like element having second rest formations on a side thereof opposite said second support portion, said first and said second rest formations being coplanar to each other thereby to allow in use said stand structure to be placed onto a supporting plane surface with said rest formations resting thereon, in use said supporting plane being a horizontal plane and said axis of rotation being vertical.

2. A structure according to claim 1, wherein said first support portion has a cusp-like shape.

3. A structure according to claim 1, wherein said rest formations are in the form of caster wheels.

4. A structure according to claim 1, wherein said first and second rotatable joint means comprise a telescopical coupling between said one and said another terminal straight portions including a slot therein extending over an arc and a pin guided therein thereby allowing relative rotation between said one and said another terminal straight portions over an arc determined by said slot and preventing relative separative displacement between said one and said another terminal portions, said arc of said slot allowing coplanar positioning of said shaped rod-like element with respect to each other and inclined relative positioning thereof.

5. A structure according to claim 1, wherein said first shaped rod-like element has a second terminal straight portion and wherein the structure includes a third shaped rod-like element having a third terminal straight portion coaxial with and rotatably coupled with said second terminal straight portion, said third shaped rod-like element including a third support portion for a third garment portion and third rest formations on a side thereof opposite said third support portion.

* * * * *